United States Patent [19]

Davidson et al.

[11] 4,075,581

[45] Feb. 21, 1978

[54] STRIPLINE QUADRATURE COUPLER

[75] Inventors: Allen Loy Davidson, Crystal Lake; Ronald Joseph Wanat, Elgin, both of Ill.

[73] Assignee: Motorola, Inc., Schaumburg, Ill.

[21] Appl. No.: 691,683

[22] Filed: June 1, 1976

[51] Int. Cl.[2] ..... H01P 5/18

[52] U.S. Cl. ..... 333/10; 333/84 M

[58] Field of Search ..... 333/10

[56] References Cited

U.S. PATENT DOCUMENTS

| | | | |
|---|---|---|---|
| 3,146,413 | 8/1964 | Butler | 333/10 X |
| 3,345,585 | 10/1967 | Hildebrand | 333/10 |
| 3,883,828 | 5/1975 | Cappucci | 333/10 |
| 3,988,705 | 10/1976 | Drapac | 333/10 |
| 3,996,533 | 12/1976 | Lee | 333/10 X |

*Primary Examiner*—Paul L. Gensler

*Attorney, Agent, or Firm*—James P. Hamley; James W. Gillman

[57] ABSTRACT

The coupler accepts four independent RF input signals, divides each input into four equal parts, and applies each part to one of four adjoining output ports. Each input signal divided part is phase shifted a multiple of 90° whereby the output ports, taken in the proper order, are in phase quadrature.

The novel coupler comprises four hybrid couplers, all of which are fabricated on a dielectric substrate. The hybrid couplers are located on the substrate in a unique interleaved configuration whereby intercouplings are formed between selected hybrid couplers. The interleaved construction results in the electrical length of all intercouplings being controlled and, preferably, all are the same length.

4 Claims, 6 Drawing Figures

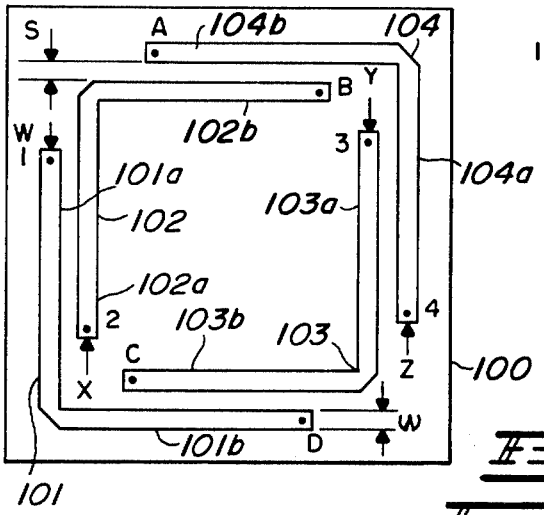
Fig. 4A
| INPUT | OUTPUT A | B | C | D |
|---|---|---|---|---|
| W | $\frac{W}{4}\angle 0°$ | $\frac{W}{4}\angle -90°$ | $\frac{W}{4}\angle -90°$ | $\frac{W}{4}\angle -180°$ |
| X | $\frac{X}{4}\angle -90°$ | $\frac{X}{4}\angle -180°$ | $\frac{X}{4}\angle 0°$ | $\frac{X}{4}\angle -90°$ |
| Y | $\frac{Y}{4}\angle -90°$ | $\frac{Y}{4}\angle 0°$ | $\frac{Y}{4}\angle -180°$ | $\frac{Y}{4}\angle -90°$ |
| Z | $\frac{Z}{4}\angle -180°$ | $\frac{Z}{4}\angle -90°$ | $\frac{Z}{4}\angle -90°$ | $\frac{Z}{4}\angle 0°$ |
Fig. 4B
Fig. 3
Fig. 1
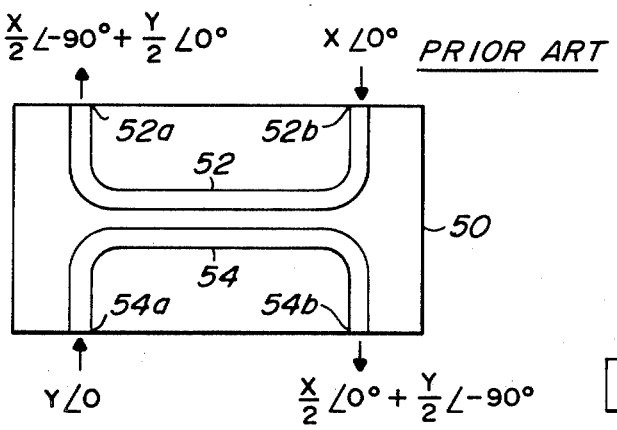
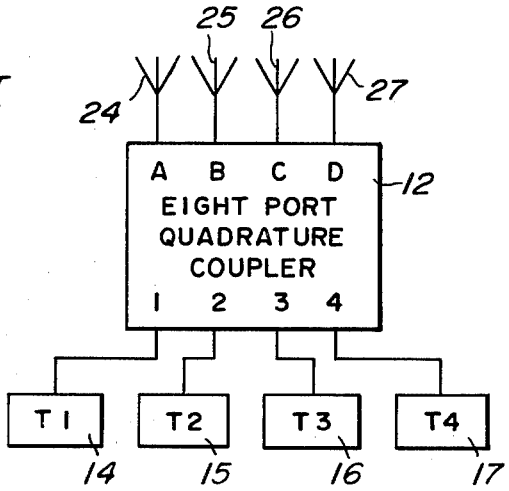
PRIOR ART
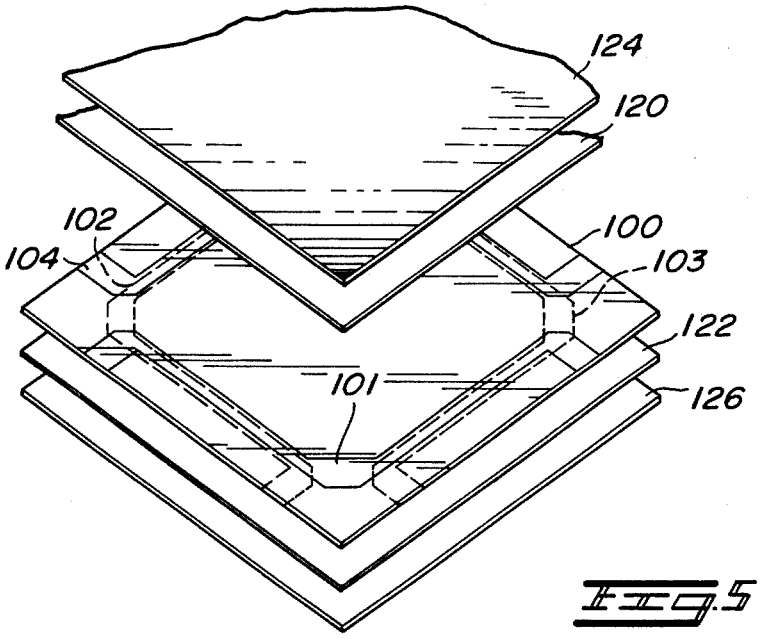
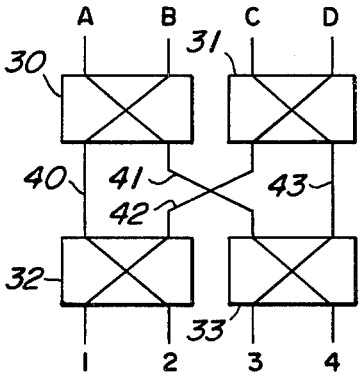
Fig. 2
Fig. 5

STRIPLINE QUADRATURE COUPLER

BACKGROUND OF THE INVENTION

This invention relates to the radio frequency communication art and, more particularly, to a multiport, stripline radio frequency signal coupler.

Stripline couplers are well known in the radio frequency communication art. A common use for such couplers is the splitting of one RF signal into two or more signals. Using a similar approach, independent RF signals may be combined, or added via couplers.

A particularly useful coupler building block is the hybrid coupler. The hybrid coupler is comprised of a pair of adjoining metallizations deposited on a common substrate. The metallizations act as a transmission line at RF frequencies whereby signals may be applied at either ends of the metallizations to produce combining signals at the metallizations'free ends.

In many applications it is necessary that a plurality of hybrid couplers be interconnected. One such system is the eight port quadrature coupler wherein each of four independent input RF signals may be split into four equal parts, with each part appearing at one of the output ports. A further feature of the quadrature coupler is that each part of the divided input signal is phase shifted whereby the output ports, when taken in the proper order, are in phase quadrature.

In the prior art it has been known that an eight port quadrature coupler may be fabricated by interconnecting four hybrid couplers with coaxial cable. This results in a cumbersome, difficult to manufacture, and relatively expensive system. Moreover, since it is essential for proper operation of the coupler that all interconnecting electrical lengths between the hybrids be identical, such prior art couplers have been subject to performance degradation due to the required close tolerances.

SUMMARY OF THE INVENTION

It is an object of this invention, therefore, to provide an improved multiport coupler which is easy to manufacture yet precise in operation.

It is a particular object of the invention to provide an eight port quadrature coupler comprising metallizations fabricated on a single substrate.

Briefly, according to the invention, a 4-input/4-output port radio frequency coupler, comprises a dielectric substrate and a plurality of N hybrid couplers. Each coupler has a pair of conductive paths, with each path having a pair of interconnected fingers. All of the couplers are fabricated on the substrate in a predetermined configuration such that the fingers interleave to form hybrid intercouplings of a selected electrical length.

Preferably, for an eight port quadrature coupler, the predetermined configuration of the interleaved fingers results in all hybrid intercouplings being of the same electrical length.

BRIEF DESCRIPTION OF THE DRAWINGS

FIG. 1 illustrates a transmission system employing an eight port quadrature coupler;

FIG. 2 illustrates a schematic diagram of the eight port quadrature coupler;

FIG. 3 illustrates the prior art hybrid coupler;

FIG. 4A illustrates one construction of the preferred stripline eight port quadrature coupler according to the invention;

FIG. 4B is a chart indicating representative electrical outputs of the coupler of FIG. 4A; and FIG. 5 is an exploded view of the preferred construction of the inventive eight port coupler.

DESCRIPTION OF THE PREFERRED EMBODIMENT OF THE INVENTION

Referring to FIG. 1, an eight port quadrature coupler 12 interconnects between four independent RF signals sources 14–17 and an antenna array comprised of four antennas 24–27. The independent signal sources, or transmitters, 14–17 couple to input ports 1–4 of the coupler 12, with the coupler's four output ports A, B, C, D feeding the four antennas 24–27.

The coupler 12 splits each input signal into four parts, applying these four parts at each of the output ports A–D. Further, each component part is phase shifted such that adjoining outputs from the coupler are in phase quadrature. This phase shifting results in the antenna array producing an optimum radiating pattern.

FIG. 2 illustrates the conventional fabrication of an eight port quadrature coupler. There, four hybrid couplers 30–33 are interconnected by coaxial cables 40–43. Each hybrid coupler 30–33 is designed to operate at one quarter of the wavelength of the RF signals concerned. The proper operation of the coupler requires that all of the cables 40–43 be of the same length. Thus, the prior art quadrature coupler of FIG. 2 is expensive to manufacture, bulky, and requires precise fabrication to achieve optimum results.

FIG. 3 illustrates a common construction of the known hybrid coupler. Fabricated on a single substrate 50 are a pair of metallizations 52, 54 having first and second ends 52*a*, 54*a* and 52*b*, 54*b*, respectively. The length of each metallization 52, 54 is selected to be one quarter of a wavelength at the center of the radio frequency band of interest.

Shown applied to the second terminal 52*b* of the first metallization 52, and to the first terminal 54*a* of the second metallization 54 are input signals X, and Y, respectively. Due to the transmission line intercoupling between the two metallizations 52, 54 each input signal X, Y is divided by 2, and phase shifted one quarter wavelength, or 90°. This results in the combined output signals at 52*a*, and 54*b* as shown. While such prior art hybrid couplers are effective for combining two signals, until the present invention it has not been known how four independent RF signals could be effectively combined in one structure.

FIG. 4A illustrates a preferred embodiment of the eight port quadrature coupler according to the invention. Fabricated on a single substrate 100 of dielectric material are a series of "L" shaped conductive paths or metallizations 101–104. The legs, or fingers of each path 101–104 are denoted by the subscripts *a, b,* with each finger having a length equal to one quarter of a wavelength at the center of the radio frequency band of interest. At the free end of each first finger 101*a*–104*a* are input terminals or ports 1–4, respectively. At the free end of each second finger 101*b*–104*b* are output terminals, or ports D, B, C and A, respectively. The input ports 1–4 and output ports A–D correspond to the similarly labeled input and output ports illustrated in FIGS. 1 and 2.

The conductive paths 101–104 are fabricated in a predetermined configuration on the substrate 100 such that intercoupling is accomplished between selected hybrids. For example, because of their close proximity intercoupling is affected between the hybrid comprised of fingers 101*a* and 102*a*, which, in turn, couple to finger 103*b* through finger 101*b*, and so on. In fact, all coupling between adjacent couplers is accomplished only through conduction via metallized paths. Thus, electrostatic and magnetic coupling is reduced to negligible proportions by the unique layout of the metallized fingers.

Hence, the interconnections between the couplers are all maintained at the same electrical length, which electrical length is substantially zero.

Further, the width *w* of each path 101–104, and the spacing *s* between the paths are predeterminedly selected in the known manner to provide the proper operating impedance, proper coupling, and suitable power handling capability as determined by the requirements of a particular system. Proper selection of the parameters *w* and *s* well known to one skilled in the art, and a full discussion thereof is given in the following references:

1. G. L. Matthaei, L. Young, E. M. T. Jones, *Microwave Filter, Impedance-Matching Networks, and Coupling Structures*, McGraw-Hill, Inc., pp 775–809; pp 174–189, 1974.

2. S. B. Cohn, "Shielded Coupled-Strip Transmission Line", IEEE Transactions - MTT, pp 29–38, October 1955; and

3. H. A. Wheeler; "Transmission-Line Properties of Parallel Strips Separated by a Dielectric Sheet", IEEE Trans. -MTT, pp 172–185, March 1965.

FIG. 4B illustrates representative outputs at output ports A–D corresponding to input signals W–Z applied to input terminals 1–4, respectively. It should be observed that each independent input RF signal is equally divided into four equal parts, e.g. W/4. Further, the intercoupling between hybrids, and the fact that each finger 101*a*, b-104*a, b* is selected to be one quarter wavelength at the center frequency of the RF frequency band of interest, results in the signals at the output ports A–D being in phase quadrature. It should be noted that the proper quadrature output is accomplished by the following sequence of output ports: A-B-D-C. That is, the output component of input signal W at output port A is w/4 at zero degrees, with the same magnitude appearing at output ports B, D, and C at minus 90°, minus 180°, and minus 90° respectively. Thus, the unique interconnected and interleaved finger construction of the hybrid results in a stripline eight port quadrature coupler which may be fabricated on a single substrate.

FIG. 5 illustrates a preferred construction of the eight port coupler, with its associated stripline "sandwiching" elements. Here, the conductive paths 101–104 are fabricated on the substrate 100 such that the first and fourth paths 101, 104 are on the top surface of the substrate 100, with the second and third paths 102, 103 being fabricated on the bottom of the substrate surface. This construction allows better control of coupling, and more consistent phasing because the electrical parameters are less sensitive to mechanical tolerances.

To complete the stripline "sandwich" a pair of dielectric surfaces 120, 122 are placed on either side of the substrate 100, with a pair of metallized ground planes 124, 126 on either side of the dielectric, thereby completing the package.

In summary, an improved stripline coupler has been illustrated which maybe fabricated on a single substrate.

While a preferred embodiment of the invention has been shown, it should be understood that many modifications and variations thereto are possible, all of which fall within the true spirit and scope of the invention.

For example, while an eight port quadrature coupler, having four input ports, and four output ports has been shown, it should be understood that the invention leads itself to fabrication of an N-input/N-output port coupler where N may be an integer equal to or greater than 4. In fact, the invention lends itself to fabrication of a plurality of hybrid couplers on the same substrate in such a configuration that the electrical length between the couplers is substantially zero.

We claim:

1. A 4-input/4-output port radio frequency coupler comprising:

a dielectric substrate material; and four quarter wave length hybrid couplers comprising a plurality of four conductive paths formed on the substrate, each path having adjacent first and second legs with an input port at the end of one leg and an output port at the end of the other leg, the conductive paths being of predetermined configuration such that the legs of each path electromagnetically couple to legs of a different path to form said four hybrid couplers, the interconnecting lengths between connected coupers all being substantially zero.

2. An eight port quadrature coupler for receiving four independent RF signals having a wavelength λ, at four input ports, splitting each of said signals into four equal portions, and reproducing each portion at one of four adjoining output ports, each output port having a phase quadrature relationship with the adjoining ports, the coupler comprising:

a dielectric substrate material; and four quarter wave hybrid couplers fabricated on said substrate, each hybrid coupler comprised of a leg from each of a pair of "L" shaped members, each leg of the "L" having a length λ/4, the hybrid couplers formed on the substrate in predetermined configuration such that the "L" members interleave to form electromagnetic intercouplings between selected hybrid couplers, with all interconnecting lengths between connected couplers being of the same electrical length.

3. The eight port quadrature coupler of claim 2 wherein each one of the pair of "L" shaped members is formed on an opposite side of the substrate.

4. The eight port quadrature coupler of claim 2 wherein the interconnecting lengths between connected couplers are all substantially zero.

* * * * *